US006398514B1

(12) United States Patent
Smith et al.

(10) Patent No.: US 6,398,514 B1
(45) Date of Patent: Jun. 4, 2002

(54) DOUBLE-ACTING ROD PUMP

(76) Inventors: Steve C. Smith, 14011 Woodlawn Ave., Tustin, CA (US) 92780; Bruce H. Menk, 253 23rd St., Costa Mesa, CA (US) 92627

( * ) Notice: Subject to any disclaimer, the term of this patent is extended or adjusted under 35 U.S.C. 154(b) by 0 days.

(21) Appl. No.: 09/721,811

(22) Filed: Nov. 22, 2000

(51) Int. Cl.[7] ..... F04F 1/06; F04F 3/00
(52) U.S. Cl. ..... 417/120; 222/309
(58) Field of Search ..... 417/120, 63, 53, 417/218, 403, 393, 118, 44.2; 222/309; 137/99

(56) References Cited

U.S. PATENT DOCUMENTS

| | | | | | |
|---|---|---|---|---|---|
| 3,764,235 | A | * | 10/1973 | Bittermann | 417/118 |
| 3,815,621 | A | * | 6/1974 | Robinson | 137/99 |
| 3,838,946 | A | * | 10/1974 | Schall | 417/395 |
| 3,912,127 | A | * | 10/1975 | Georgi | 222/309 |
| 4,309,152 | A | * | 1/1982 | Hagen | 417/218 |
| 4,354,806 | A | * | 10/1982 | McMillin et al. | 417/393 |
| 4,720,246 | A | * | 1/1988 | Morton | 417/53 |
| 4,895,497 | A | * | 1/1990 | Schlinkheider | 417/403 |
| 4,981,418 | A | * | 1/1991 | Kingsford et al. | 417/63 |
| 5,404,767 | A | * | 4/1995 | Sutherland | 74/89.15 |
| 6,015,268 | A | * | 1/2000 | Hetherington | 417/63 |
| 6,074,170 | A | * | 6/2000 | Bert | 417/44.2 |
| 6,224,344 | B1 | * | 5/2001 | Hasbrouck | 417/120 |

* cited by examiner

*Primary Examiner*—Teresa Walberg
*Assistant Examiner*—Leonid M Fastovsky
(74) *Attorney, Agent, or Firm*—Roy A. Ekstrand

(57) ABSTRACT

A pair of end plates are maintained in a spaced apart relationship by a plurality of guide rods secured therebetween. A carriage defines a plurality of apertures which receive the guide rods and which provide slidable support for the carriage between the end plates. An elongated externally threaded pump screw is rotatably supported between the end plates and is coupled to a bi-directional motor. A ball nut is secured to the movable carriage which engages the pump screw such that rotation of the pump screw in either direction produces a corresponding vertical movement of the carriage between the end plates. A first plurality of pump sections having respective fluid cylinders and pump rods operative therein are coupled between the carriage and one of the end plates. A second plurality of pump sections also having respective fluid cylinders and pump rods are operatively coupled between the carriage and the remaining end plate. The first and second pluralities of pump sections are coupled to a fluid supply and a high pressure output line by a crossover valve. The motor is driven for rotation in a first direction to drive the carriage toward the lower end plate and in a second direction to raise the carriage toward the upper end plate thereby operating each pump section to produce a double acting rod pump. A sensor and pair of targets is operative to limit the extent of travel of carriage between a maximum upper position and a maximum lower position.

13 Claims, 8 Drawing Sheets

DOUBLE-ACTING ROD PUMP

FIELD OF THE INVENTION

This invention relates generally to fluid pumps and particularly to those capable of precision fluid flow and/or metering delivery.

BACKGROUND OF THE INVENTION

Pumps comprise one of the most common and well developed as well as well known types of basic machines. The essential function of a pump is the displacement and movement or pressurization of a fluid. The majority of pumps may be divided into a basic classification as either reciprocating or rotary action pumps. Reciprocating pumps typically utilize one or more cylinders together with appropriate valves for controlling fluid flow to and from the cylinders. Each cylinder is fitted with a moving piston which in turn is usually coupled to crank mechanism for imparting piston movement within the cylinder in response to rotation of an input power or drive shaft.

One of the more recently developed types of reciprocating pumps is generally referred to as a "rod pump". Rod pumps typically find use in high precision or fluid metering applications. Typically, rod pumps utilize a fluid cylinder having a closed end bore within which a pump rod is moved. The open end of the fluid cylinder bore supports a pressure seal against the pump rod for maintaining pressure within the cylinder bore. As the pump rod is drawn from the cylinder bore, low pressure or "draw" is created in the cylinder bore allowing fluid flow into the cylinder. Conversely, as the pump rod is driven into the cylinder bore the fluid is pressurized. Combinations of check valves are typically used to control fluid flow to and from the pump.

In contrast, rotary pumps may be generally characterized as apparatus having a shaft coupled to a source of rotary power which is supported within a pump body. The latter, defines a chamber or cavity within which a fluid movement or displacement device is rotated by the input power shaft. Perhaps the most pervasive type of rotary pump may be generally described as an impeller type pump. In such pumps, a rotor is positioned within the pump chamber and rotated by the input power shaft. The rotor in turn supports a plurality of blades which are sized and configured in general correspondence with the interior chamber of the pump housing. An input port and an output port are formed in the pump housing in communication with the chamber. As the input drive shaft rotates the rotor and its plurality of impeller blades within the pump chamber, the fluid is drawn into the chamber through the input port and forced outwardly through the output port.

Another type of rotary pump is typically referred to as a turban or vane type pump. The turban or vane pump utilizes a housing defining a chamber which is usually cylindrical in shape which supports a plurality of static vanes radially disposed within the chamber interior. An armature is rotatably supported within the pump chamber and further supports a plurality of rotating vanes which are moveable with respect to the static vanes. A drive shaft is coupled to a source of operative rotary power and is further coupled to the armature. As rotary power is applied to the armature, the interaction of the rotating vanes and static vanes produces a turban-like displacement of the fluid within the chamber. Typically an input port is coupled to one end of the chamber while an output port is coupled to the downstream end of the pump chamber.

Still another type of rotary action pump is referred to generally as a "peristaltic" which is often referred to as a "hose pump". Peristaltic pumps utilize a housing within which a generally cylindrical chamber is formed. A flexible tubing or hose is positioned against the outer surface of the housing chamber. One end of the tubing or hose is coupled to an input fluid supply while the remaining end forms an output port for the pump. A rotor is rotatably supported within the chamber and further supports one or more rollers about its periphery. The rollers are positioned against the flexible tubing or hose and are of sufficient size to deform the hose to provide pinching or closure at the point of roller pressure. A drive shaft is coupled to the rotor and to a source of rotational power. As the rotor rotates, the rollers displace quantities of fluid in the direction of rotor rotation to transfer the fluid from the input source to the output port.

While most pumps are used in applications which require the pumps to simply run for relatively long periods at a so-called steady state, in certain environments pumps must also be capable of providing short term small volume runs to transfer fluid in more precise quantities. Such pumps are often referred to as "fluid metering" pumps and are characterized by precise volume delivery of fluid. In many instances, such fluid metering pumps are used in an operative environment in which the rotating member is moved through small angular displacements substantially less than a full rotation.

While the above described prior art pumps have been the subject of substantial refinement and development, they have yet to provide pumps which are capable of both steady state operation and fluid metering operation. Many of the above described prior art pumps have been subject to an undesirable tendency to impart a pulsating characteristic to the fluid flow. There remains therefore a continuing need in the art for an improved pump which is capable of providing smooth pulse free fluid flow as well as accurate fluid metering operation.

SUMMARY OF THE INVENTION

Accordingly, it is a general object of the present invention to provide an improved precision flow pump. It is a more particular object of the present invention to provide an improved pump which is capable of providing extremely precise fluid metering operation through partial pump strokes as well as relatively pulse-free fluid flow during more conventional continuous pump action.

In accordance with the present invention there is provided a double-acting rod pump comprising: a frame support; a carriage slidably movable upon the frame support in first and opposed directions; at least one first rod pump section coupled to the carriage and the frame support; at least one second rod pump section coupled to carriage and the frame support in an operational relationship opposite to the at least one first rod pump section; a pump screw rotatably supported by the support frame; a bi-directional motor for rotating the pump screw in first and second rotational directions; engagement means on the carriage for engaging the pump screw such that first and second rotational direction rotation of the pump screw moves the carriage in opposed first and second direction movement; and valve means coupled to the at least on first rod pump section and the at least one second rod pump section for controlling fluid flow to and from the first and second rod pump sections.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
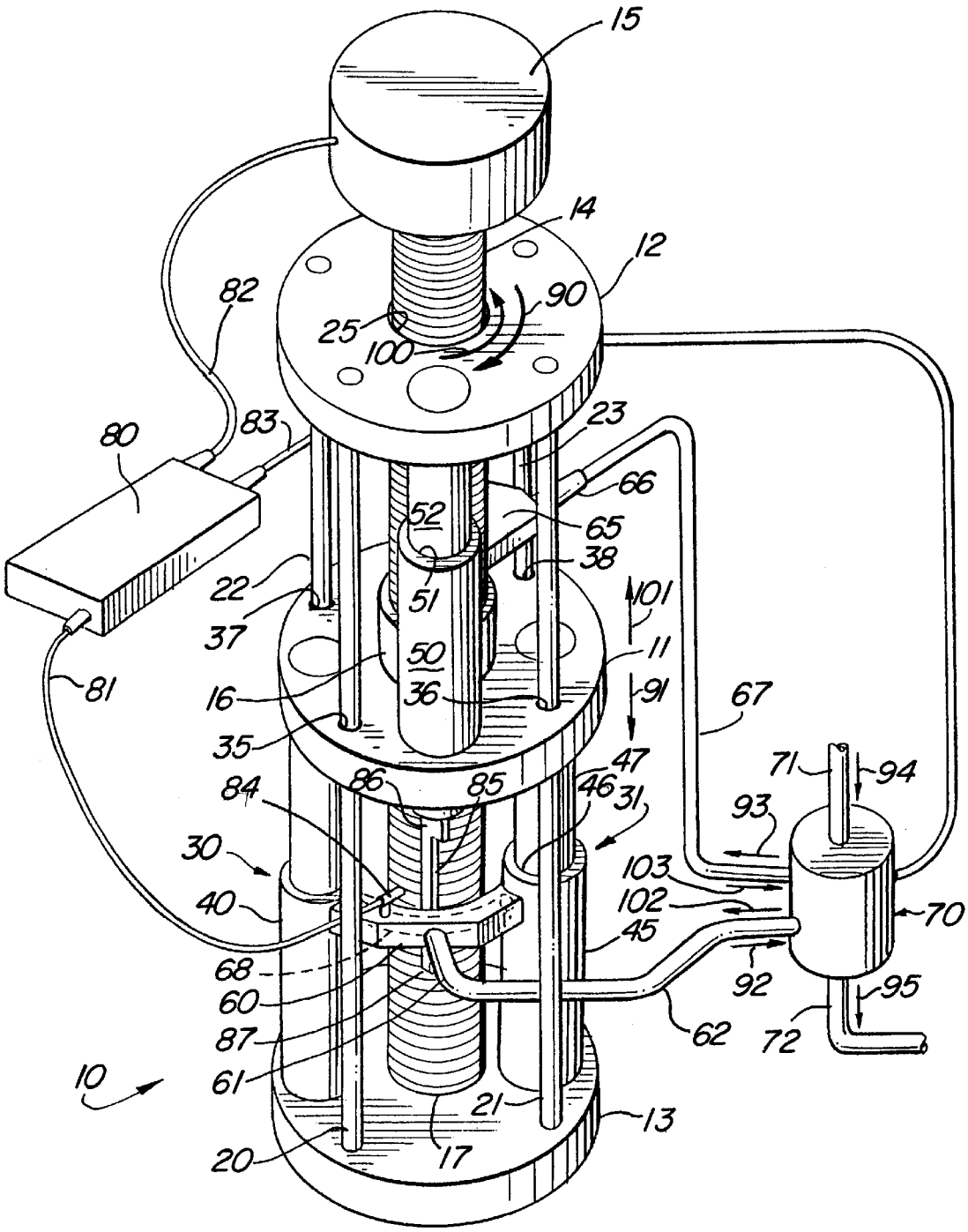
FIG. 1 sets forth a perspective view of a double-acting rod pump constructed in accordance with the present invention.

FIG. 1 sets forth a perspective view of a double-acting rod pump constructed in accordance with the present invention and generally referenced by numeral 10. Pump 10 includes a pair of end plates 12 and 13 supported in a spaced apart relationship by a plurality of elongated cylindrical rigid guide rods 20, 21, 22, and 23. Guide rods 20 through 23 are secured to end plates 12 and 13 in accordance with conventional fabrication techniques such as threaded fastening or the like (not shown) to provide a rigid frame structure. Thus, end plates 12 and 13 as well as guide rods 20 through 23 are preferably formed of a rigid metal material or the like. Pump 10 further includes a carriage 11 having a plurality of bearings 35, 36, 37 and 38 through which guide rods 20, 21, 22 and 23 respectively are passed. The size relationship of bearings 35 and 38 and guide rods 20 through 23 is a precision sliding fit allowing carriage 11 to move upon guide rods 20 through 23 in the directions indicated by arrows 91 and 101.

Pump 10 further includes an elongated pump screw 14 having a lower end 17 rotatably supported by end plate 13 in accordance with conventional fabrication techniques such as a conventional bearing support (not shown). Carriage 11 supports an internally threaded ball nut 16 through which pump screw 14 extends in a precision threaded engagement. Ball nut 16 is secured to carriage 11 by conventional attachment such as precision fasteners (not shown) or the like. End plate 12 further defines an aperture 25 through which the upper end of pump screw 14 passes. The upper most end of pump screw is coupled to the rotatable output shaft of a motor 15. Motor 15 may be constructed in accordance with conventional fabrication techniques and comprises a precision bi-directional motor capable of rotating pump screw 14 in either of the rotational directions indicated by arrows 90 and 100.

It will be apparent to those skilled in the art that virtually any rotational drive may be used in place of motor 15 without departing from the spirit and scope of the present invention. The essential function of motor 15 is that of providing rotation of pump screw 14. Thus, other rotational power devices such as hydraulic and air-driven motors may be used.

In accordance with the present invention, a pair of pump sections 30 and 31 are coupled between end plate 13 and the underside of carriage 11. Pump sections 30 and 31 comprise precision rod pumps having respective fluid cylinders 40 and 45 and defining respective closed end bores 41 and 46. Further, pump section 30 includes a pump rod 42 received within bore 41 having its upper end secured to carriage 11 in the manner set forth below. Similarly, pump section 31 includes a precision pump rod 47 extending into bore 46 and having its upper end connected to carriage 11. As is set forth below in FIG. 2, fluid cylinders 40 and 45 define respective port apertures which are coupled to a manifold 60. Manifold 60 is supported upon fluid cylinders 40 and 45 and defines an internal manifold passage 68. Passage 68 conducts fluid from the respective ports of fluid cylinders 40 and 45 to a coupler 61 also secured to manifold 60.

Figure 4:
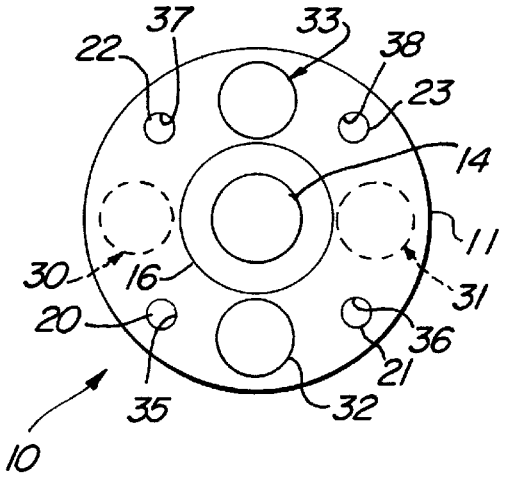
FIG. 4 sets forth a section view of the present invention double-acting rod pump taken along section lines 4—4 in FIG. 3.

Pump 10 further includes a second pair of pump sections 32 and 33 (pump section 33 seen in FIG. 4). In the embodiment of FIG. 1, pump sections 32 and 33 are substantially identical to pump sections 30 and 31. However, it will be noted in embodiments set forth below, that different pump sections may be utilized within the same double-acting pump apparatus of the invention without departing from the spirit and scope thereof. However, suffice it to note here, that pump section 32 is substantially identical to pump sections 30 and 31 in the embodiment of pump 10 shown in FIG. 1. Thus, pump section 32 includes a fluid cylinder 50 defining an internal closed end bore 51. Fluid cylinder 50 is secured to carriage 11 in the manner set forth below. Pump section 32 also includes a precision pump rod 52 received within bore 51. The upper end of pump rod 52 is secured to end plate 12. While not seen in the perspective view of FIG. 1 due to the presence of pump screw 14, it will be understood that pump section 33 (seen in FIG. 4) is positioned on the opposite side of end plate 12 and is coupled between carriage 11 and end plate 12 in the identical manner to the relationship of pump section 32. By way of further similarity of pump sections 30 and 31, pump sections 32 and 33 are coupled to a manifold 65 which is substantially identical to manifold 60. Thus, manifold 65 defines an internal coupling passages such as passage 68 of manifold 60 which communicate fluid flow to-and-from pump sections 32 and 33 to a coupler 66.

Pump 10 further includes a sensor 84 which preferably comprises an optical sensor and detector of conventional fabrication. Typically, sensor 84 is fabricated to include a light source such as a light emitting diode (LED) together with a photo sensitive element such as a photo transistor. The function of sensor 84 is fulfilled as the sensor illuminates the region directly in front of the sensor and produces a signal output in response to the amount of light reflected back to the photo sensitive element therein. Pump 10 further includes a sensor target support 85 secured to carriage 11 by conventional fasteners or the like (not shown). Target support 85 includes a relatively upper target 86 and a relatively lower target 87 at the opposed ends thereof. The remainder of target support 85 is fabricated and positioned with respect to sensor 84 such that a greatly reduced return reflection is received by sensor 84 unless either of targets 86 or 87 are moved into alignment with sensor 84. The operation of sensor 84 and targets 86 and 87 is set forth below in FIGS. 5 and 6 in greater detail. However, suffice it to note here, that sensor 84 is able to produce a first signal output condition indicative of the alignment of upper target 86 with sensor 84 and a second signal condition indicative of the alignment of target 87 with sensor 84.

It will be apparent to those skilled in the art that a variety of sensor devices may be substituted for the optical device and target pair provided by sensor 84 and targets 86 and 87. The essential function of such devices is that of providing "end-of-travel" indication to control unit 80 which then responds by reversing rotation of pump screw 14. Thus, sensor 84 may be replaced, for example, by other sensors such as Hall effect sensors or other energy devices such as ultrasonic or air pressure. By way of further example, sensor 84 and targets 86 and 87 may be replaced by a pair of micro-switches and actuator. All of the foregoing will be clearly understood to fall within the spirit and scope of the present invention.

Figure 3:
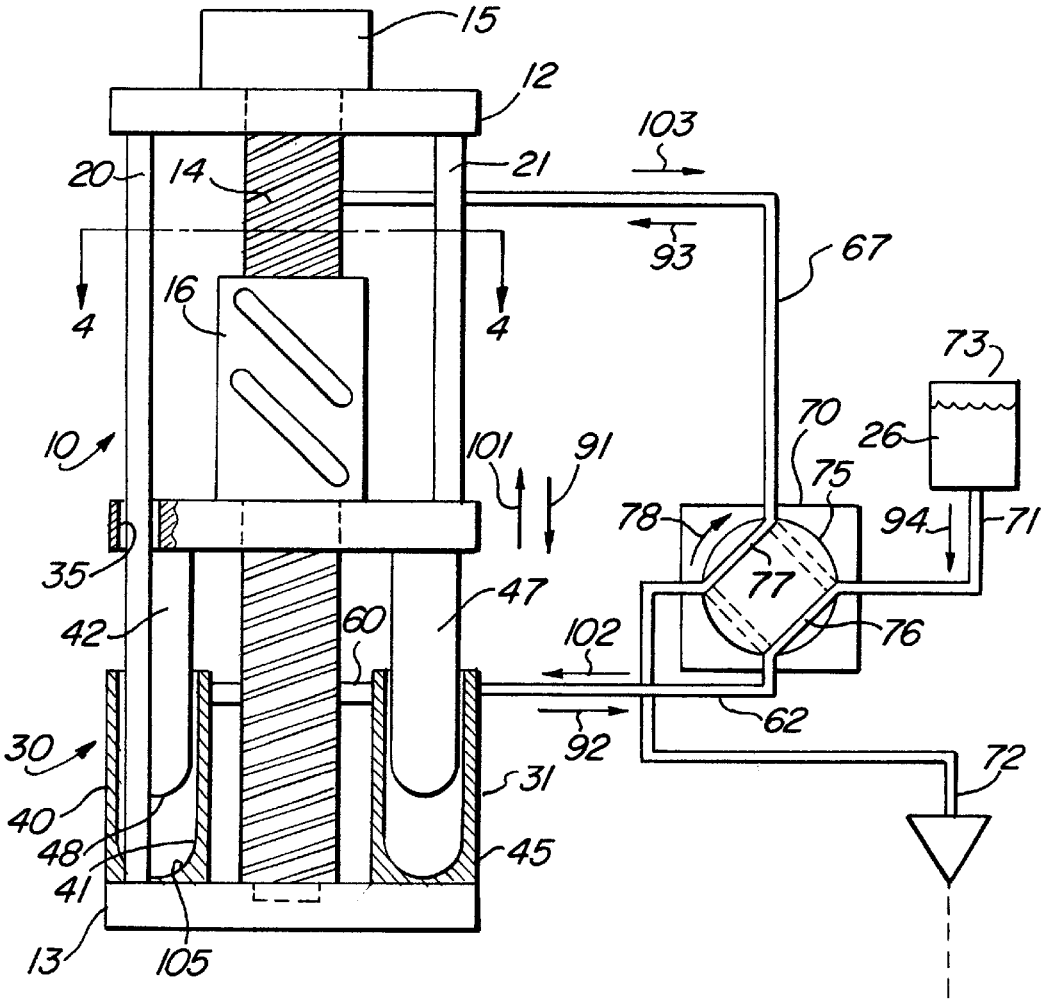
FIG. 3 sets forth a partially section side elevation view of the present invention double-acting rod pump and surrounding apparatus.

Pump 10 further includes a crossover valve 70 the operation of which is illustrated below in FIG. 3 in greater detail. Suffice it to note here, that crossover valve 70 is electrically and pneumatically operated and is of conventional fabrication techniques providing conventional switching of fluid flow. Accordingly, crossover valve 70 is coupled to a fluid supply line 71 which, as is seen in FIG. 3, is further coupled to a fluid reservoir 73. Further, crossover valve 70 is coupled to a pressure output line 72. The couplings of crossover valve 70 are completed by a fluid line 62 which couples fluid flow from coupler 61 of manifold 60 to crossover valve 70 and a fluid line 67 which couples a fluid flow between crossover valve 70 and coupler 66 of manifold 65.

Finally, pump 10 includes a control unit 80 having an electronic control circuit operative therein. Control unit 80 includes a signal input line 81 coupled to sensor 84 and a valve control line 83 operatively coupled to crossover valve 70. Control unit 80 further includes, a motor control line 82 coupled to bi-directional motor 84. While not seen in FIG. 1, it will be understood that control unit 80 is also coupled to a convention source of operative power which is utilized in controlling crossover valve 70 and bi-directional motor 15.

In operation, and by way of overview, it will be noted that fluid cylinders 40 and 45 of pump sections 30 and 31 are secured to end plate 13 while pump rods 42 and 47 are secured to carriage 11. As a result, as carriage 11 is moved due to rotation of pump screw 14 within ball nut 16, the displacement of pump rods 42 and 47 within fluid cylinders 40 and 45 is changed. Similarly, pump sections 32 and 33 (pump section 33 seen in FIG. 4) are similarly secured between carriage 11 and end plate 12 with the difference being the attachment of fluid cylinder 50 of pump section 32 to carriage 11 and the attachment of pump rod 52 to end plate 12. Again, while not seen in FIG. 1 due to the perspective view therein, it will be understood that pump section 33 is substantially identical to pump section 32 and is positioned on the opposite side of pump screw 14. Thus, it will be noted that movement of carriage 11 moves pump rods 42 and 47 as well as the fluid cylinders of pump sections 32 and 33 (seen in FIG. 4). This provides the double-acting action of the present invention rod pump. With temporary reference to FIGS. 5 and 6, the relationship between movement of carriage 11 and the various pump sections of pump 10 may be readily understood in the simplified drawings thereof.

In operation, control unit 80 energizes motor 15 to rotate producing a corresponding rotation of pump screw 14. Assuming initially that pump screw is rotating in the direction indicated by arrow 90, the engagement of pump screw 14 and ball nut 16 causes carriage 11 to be moved downwardly toward end plate 13 in the direction indicated by arrow 91. The downward movement of carriage 11 drives pump rods 42 and 47 deeper into fluid cylinders 40 and 45 respectively producing pressurization of the fluid therein and forcing fluid under pressure outwardly from cylinders 40 and 45 through manifold 60 and coupler 61. The fluid flow under pressure at coupler 61 flows through fluid line 62 in the direction indicated by arrow 92. The position of crossover valve 70 is controlled by control unit 80 and during the downward stroke of carriage 11 couples fluid line 62 to pressure output line 72 allowing the fluid under pressure to flow outwardly through output line 72 in the direction indicated by arrow 95.

Concurrently, as the rotation of pump screw 14 drives carriage 11 downwardly in the direction indicated by arrow 91, the distance between carriage 11 and end plate 12 is increased causing pump rod 52 to be withdrawn from bore 51 of fluid cylinder 50. Again, while not seen in FIG. 1, it will be understood that a corresponding action is taking place within pump section 33 seen in FIG. 4. As the pump rods of pump sections 32 and 33 are drawn from their respective fluid cylinder bores due to the downward movement of carriage 11, fluid is drawn into manifold 65 via coupler 66 and fluid line 67. The position of crossover valve 70 during downward movement of carriage 11 couples fluid supply line 71 to fluid line 67. As a result, as pump sections 32 and 33 draw fluid into their respective fluid cylinders, fluid flows from reservoir 73 (seen in FIG. 3) through fluid supply line 71 in the direction indicated by arrow 94 and thereafter, flows in the direction indicated by arrow 93 through fluid line 67.

Thus, as carriage 11 continues to move downwardly, a pressure stroke is occurring within pump sections 30 and 31 while simultaneously and intake stroke is occurring within pump sections 32 and 33. This double-acting pump operation allows a simultaneous pumping and refilling to occur within pump 10. The downward stroke of carriage 11 continues as motor 15 continues to rotate pump screw 14 in the direction indicated by arrow 90.

As carriage 11 moves downwardly, the position of sensor targets 86 and 87 moves correspondingly with respect to sensor 84. At a predetermined point in downward movement of carriage 11, upper target 86 is substantially aligned with sensor 84 causing sensor 84 to produce an output signal indicative of the alignment of upper target 86. Because upper target 86 is substantially larger than lower target 87, the detected light reflection from target 86 produces a characteristic signal which when communicated to control unit 80 indicated the end of a downward stroke of carriage 11. Control unit 80 then responds by producing an output signal to crossover valve 70 reversing its valve position and reverses the operative power to motor 15 via connecting line 82. As a result, crossover valve 70 switches in synchronism with the reversal of motor 15. The reversal of motor 15 reverses the direction of rotation of pump screw 14 causing screw 14 to rotate in the direction indicated by arrow 100. This reversed rotation of pump screw 14 causes carriage 11 to be lifted in the direction indicated by arrow 101. As carriage 11 moves upwardly, pump rods 42 and 47 begin their withdraw from fluid cylinders 40 and 45. Concurrently, the pump rods within pump sections 32 and 33 (seen in FIG. 4) are driven into their respective fluid cylinders. As carriage 11 continues to move upwardly and pump rods 42 and 47 are drawn from bores 41 and 46 of fluid cylinders 40 and 45, fluid is drawn through crossover valve 70 via supply line 71 and flows through fluid line 62 in the direction indicated by arrow 102. Thus, fluid is drawn from the fluid supply reservoir through line 62 into manifold 60 and fluid cylinders 40 and 45. In other words, pump sections 30 and 31 are now operating in an intake stroke.

Concurrently, the upward movement of carriage 11 drives the pump rods of pumps sections 32 and 33 into their respective fluid cylinders producing pressurized fluid flow and a pressure stroke. The movement of pump rods into the fluid cylinders of pump sections 32 and 33 forces pressurized fluid outwardly through manifold 65 and coupler 66 into fluid line 67. The reverse position of crossover valve 70 couples this pressurized fluid flow from fluid line 67 in the direction of arrow 103 outwardly through pressure output 72 in the direction indicated by arrow 95.

Figure 9:
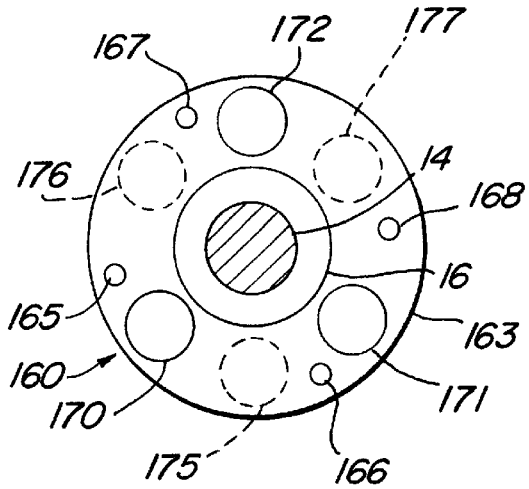
FIG. 9 sets forth a section view of an alternate embodiment of the present invention double-acting rod pump.
Figure 10:
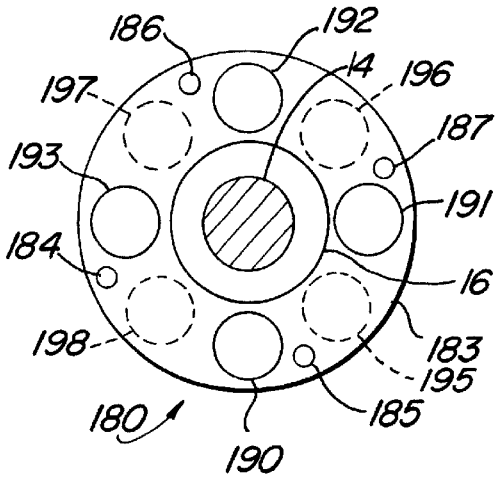
FIG. 10 sets forth a section view of a still further view alternate embodiment of the present invention double-acting rod pump.

As carriage 11 continues its upward movement in the direction indicated by arrow 101, target 87 moves into alignment with sensor 84. As mentioned above, target 87 is substantially smaller than target 86. Accordingly, target 87 reflects a substantially reduced amount of light back to sensor 84. As a result, a smaller output signal is produced by sensor 84 which is coupled to control unit 80 by coupling line 81. Control unit 80 responds to this smaller sensor output signal by again reversing crossover valve 70 position and again reversing the rotational direction of motor 15. The reversal of motor 15 rotates pump screw 14 once again in the direction indicated by arrow 90 causing carriage 11 to be driven downwardly in the direction indicated by arrow 91. Thus, a complete pump cycle is repeated as motor 15 and pump screw 14 drive carriage 11 up and down between end plates 12 and 13. The operation of crossover valve 70 causes the appropriate switching between the fluid supply and the pressure output of the pump environment to maintain proper fluid flow. The double-acting character of pump 10 provides a virtually continuous flow in which the reversal of carriage 11 direction movement is virtually undetectable. In further accordance with the present invention, the precision coupling between pump screw and ball nut 16 maintains precise positioning of carriage 11. Accordingly, pump 10 may be operated to provide a virtually continuous flow with high precision or alternatively, may be operated as a precision displacement pump in which the rotation of motor 15 is intermittent to provide small controlled highly precise fluid displacement. It will be noted that the embodiment shown in FIG. 1 utilizes a total of four pump sections positioned on opposite sides of carriage 11. It will be further noted that the location of pump sections 30 and 31 is displaced ninety degrees from the positions of pump sections 32 and 33 (seen in FIG. 4). It has been found that this off-set alignment of pump sections is advantageous in fabricating pump 10. However, it will be apparent from the descriptions and examples set forth below, that this alignment of pump sections is not mandatory and that other alignments and combinations of pump sections may be utilized without departing from the spirit and scope of the present invention. For example, different numbers of pump sections are illustrated in FIGS. 9 and 10. By way of further example, FIGS. 7 and 8 set forth embodiments of the present invention double-acting rod pump in which pump sections of different displacements of sizes are utilized to provide different fluid flow rates from each particular fluid.

Figure 2:
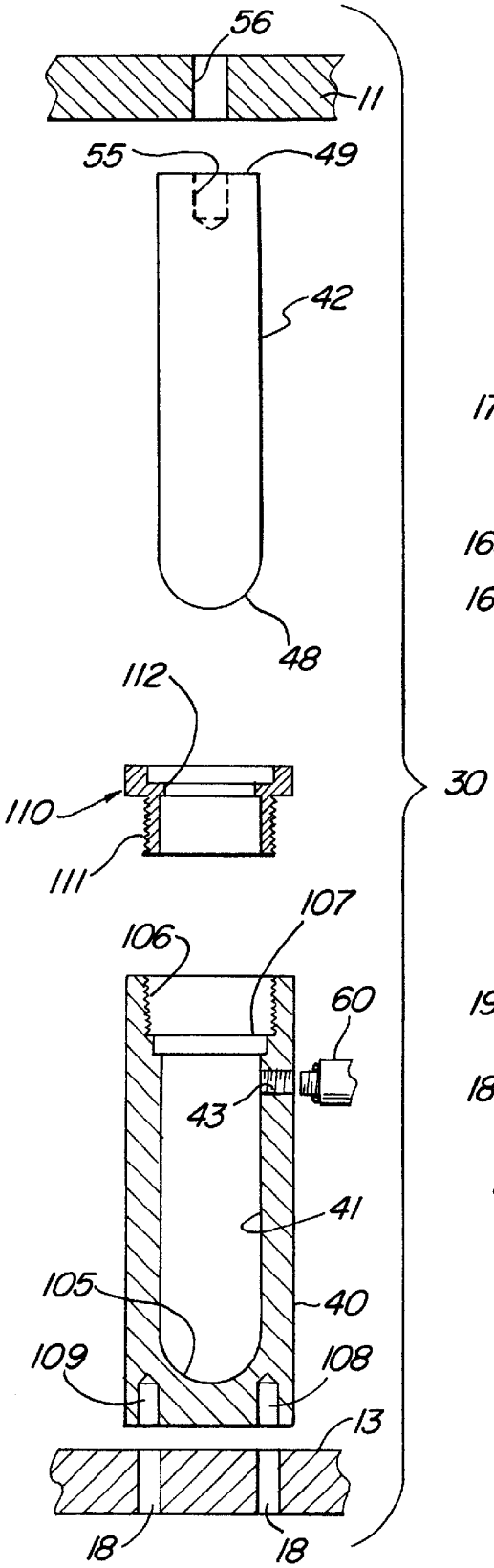
FIG. 2 sets forth a partially sectioned assembly view of an exemplary pump section of the present invention double-acting rod pump.

FIG. 2 sets forth a partially sectioned assembly view of a typical pump section utilized in the present invention double-acting rod pump. For purposes of illustration, pump section 30 is shown. However, it will be understood by those skilled in the art, that pump section 30 is illustrative of the remaining pump sections utilized in the present invention double-acting rod pump. Accordingly, the illustration and descriptive material relating to pump section 30 set forth in FIG. 2, will be understood to be equally illustrative and descriptive of the remaining pump sections utilized in the present invention double-acting pump.

More specifically, pump section 30 includes a fluid cylinder 40 having a closed end bore 41 formed therein. A threaded recess 106 receives a resilient annular seal 107. Fluid cylinder 40 further defines a spherical-shaped closed end 105 at the bottom of bore 41. A fluid port aperture 43 is formed in the wall of fluid cylinder 40. Port 43 is operative to receive a coupling from a fluid manifold such as manifold 60. For example, port 43 may utilize a resilient seal or the like to engage manifold 60 in a pressure resistant fluid tight coupling. Other couplings of manifold 60 to port 43 constructed in accordance with conventional fabrication techniques may be utilized. The lower end of fluid cylinder 40 defines a plurality of threaded bores such as bores 108 and 109. Bores 108 and 109 receive conventional threaded fasteners (not shown) which extend through apertures such as apertures 18 formed in plate 13 to secure fluid cylinder 40 to plate 13.

Pump section 30 further includes a threaded collar 110 having an aperture 112 formed therein. Threaded collar 110 further defines a threaded portion 111 which engages threaded recess 106 and secures threaded collar 110 within the upper end of fluid cylinder 40. As collar 110 is threaded into threaded recess 106, seal 107 is compressed to provide a fluid tight seal.

Pump section 30 further includes a pump rod 42 forming a generally elongated cylindrical member having a domed end 48. The diameter of pump rod 42 and the shape of domed end 48 are configured to fit within bore 41 and closed end 105 of fluid cylinder 40. Pump rod 42 further defines a generally flat upper end 49 having a threaded aperture 55 formed therein. Aperture 55 receives a conventional threaded fastener (not shown) which extends through aperture 56 of carriage 11 to secure upper end 49 of pump rod 42 to the underside of carriage 11.

In the assembly of pump section 30, pump rod 42 is passed through aperture 112 and collar 110 is positioned upon pump rod 42. Thereafter, end 48 of pump rod 42 and a substantial portion of the lower end of pump rod 42 is passed through threaded recess 106 and seal 107 into bore 41. The final assembly of pump section 30 is completed as threaded collar 110 is then threadably fitted within recess 106 to compress seal 107 upon the exterior surface of pump rod 42. Thus, pump rod 42 is able to move upwardly and downwardly within bore 41 while seal 107 maintains a pressure resistant fluid tight seal against the outer surface of pump rod 42. As pump rod 42 is forced downwardly into bore 41, fluid within bore 41 is pressurized and forced outwardly through port 43. Conversely, as pump rod 42 is withdrawn upwardly with respect to bore 41, a lower pressure is created within bore 41 allowing fluid to be drawn into bore 41 via port 43.

FIG. 3 sets forth a partially section side elevation view of pump 10 together with crossover valve 70. The purpose of FIG. 3, is to illustrate the switching of crossover valve 70 and its interaction with the carriage 11. Accordingly, it will be recognized that FIG. 3 is a somewhat simplified diagram in which many of the operative components of the present invention double-acting rod pump have been omitted. For example, pump sections 32 and 33 (seen in FIG. 4) are omitted from FIG. 3 to facilitate illustration of the spacial relationship between carriage 11, ball nut 16, pump screw 14 and motor 15. It will be understood however, in the anticipated fabrication of the embodiment shown in FIG. 3, that an additional pair of pump sections 32 and 33 are positioned between carriage 11 and upper plate 12.

More specifically, pump 10 includes a pair of end plates 12 and 13 supported in a spaced relationship by a plurality of guide rods such as guide rods 20 and 21. A carriage 11 defines a plurality of apertures such as aperture 35 through which the guide rods pass allowing carriage 11 to be supported upon the guide rods and to be movable between end plates 12 and 13. A pump screw 14 having an external thread is rotatably supported between end plates 12 and 13 and is coupled to a bi-directional motor 15. Carriage 11 defines an aperture 27 through which pump screw 14 passes. A ball nut 16 fabricated in accordance with conventional fabrication techniques defines an internal thread (not shown) which precisely fits and engages pump screw 14. Ball nut 16 is secured to the upper surface of carriage 11 using conventional fasteners (not shown). A pair of pump sections 30 and 31 are coupled between end plate 13 and carriage 11. As mentioned above, a corresponding pair of pump sections 32 and 33 (seen in FIG. 4) are secured between carriage 11 and end plate 12 but omitted from FIG. 3 to facilitate illustration of ball nut 16 engaging pump screw 14. Pump section 30 is fabricated in the manner set forth above in FIG. 2 and includes a fluid cylinder 40 defining an internal bore 41 having a spherical end 105. Fluid cylinder 40 is secured to plate 13. Pump section 30 further includes a pump rod 40 having an upper end secured to carriage 11 and a lower end 48 received within bore 41. Similarly, pump section 31 includes a fluid cylinder 45 defining an internal bore within which a pump rod 47 is received. As mentioned above, the rotation of motor 15 drives pump screw 14 to move carriage 11 vertically in a downward movement to drive pump rods 42 and 47 into fluid cylinders 40 and 45 or alternatively, rotates in an opposite direction to raise carriage 11 withdrawing pump rods 42 and 47 from fluid cylinders 40 and 45 respectively.

A crossover valve 70 defines an interior cavity within which a ball 75 is precision fitted. Ball 75 is rotatable in ninety degree increments and includes a pair of fluid passages 76 and 77. Crossover valve 70 is coupled to fluid lines 62 and 67 in the manner set forth above in FIG. 1. It will be recalled that fluid line 62 is coupled to pump sections 30 and 31 while fluid line 67 is coupled to pump sections 32 and 33 (seen in FIG. 4). Crossover valve 70 is further coupled to a fluid line 71 which in turn is coupled to a fluid reservoir 73. A high pressure output line 72 is also coupled to crossover valve 70.

In the position shown in the solid line representation, crossover valve 70 is rotationally positioned such that passage 76 provides fluid coupling between reservoir supply line 71 and coupling line 62 while passage 77 of ball 75 provides fluid coupling between high pressure output line 72 and fluid line 67. Thus, it will be apparent from the descriptions set forth above in connection with FIG. 1, that the solid line position shown for ball 75 of crossover valve 70 corresponds to the condition of valve 70 as carriage 11 is moved upwardly in the direction indicated by arrow 101. Thus, as carriage 11 moves upwardly, pump rods 42 and 47 are being withdrawn from fluid cylinders 40 and 45 respectively. This withdraw of the pump rods produces a low pressure with the fluid cylinders drawing fluid into fluid cylinders 40 and 45. This low pressure and fluid draw allows fluid to flow from reservoir 73 in the direction indicated by arrow 94 through passage 76 of ball 75 and into fluid cylinders 40 and 45 in the direction indicated by arrow 102. Conversely, in the manner described above, it will be understood that the upward movement of carriage 11 is simultaneously forcing the respective pump rods of pump sections 32 and 33 into their respective fluid cylinders. The insertion of pump rods into the fluid cylinders in turn forces fluid outwardly from the fluid cylinders4 in the direction indicated by arrow 103. As the high pressure fluid flows through fluid line 67, it is coupled by passage 77 of ball 75 into high pressure line 72.

When the direction of movement of carriage 11 is reversed and carriage 11 moves downwardly in the direction indicated by arrow 91, ball 75 is moved in the direction indicated of arrow 78 to the dashed line position. This position of ball 75 couples the reservoir line 71 to fluid line 67 and couples pressure line 72 to fluid line 62. As a result, fluid is drawn into pump sections 32 and 33 (seen in FIG. 4) from reservoir 73 as carriage 11 continues to move downwardly. Concurrently, fluid is forced under pressure from pump sections 30 and 31 into pressure line 72 via fluid line 62 and passage 76 of crossover valve 70.

FIG. 4 sets forth a section view of pump 10 taken along section lines 4—4 in FIG. 3. As described above, pump 10 includes a carriage 11 supported upon a pump screw 14 by a ball nut 16. As is also described above, ball nut 16 is secured to carriage 11 by conventional attachments such as a plurality of threaded fasteners (not shown). Carriage 11 defines a plurality of apertures 351 36, 37 and 38 which receive respective guide rods 20, 21, 22 and 23 in a sliding fit. Carriage 11 supports a pair of pump sections 32 and 33 positioned on opposite sides of pump screw 14. As is described above, pump sections 32 and 33 are coupled between carriage 11 and plate 12 (seen in FIG. 1). In addition, pump 10 includes a pair of pump sections 30 and 31 positioned between carriage 11 and plate 13 (seen in FIG. 1). Pump sections 30 and 31 are positioned beneath carriage 11 and are located on opposite sides of pump screw 14 in a ninety degree relationship to the alignment to pump sections 32 and 33.

It will be apparent to those skilled in the art that a variety of combinations of pump sections may be used within the present invention double-acting rod pump without departing from the spirit and scope of the present invention. Accordingly, in several of the embodiments set forth below in FIGS. 7, 8, 9 and 10 different combinations of pump sections are utilized in the present invention double-acting rod pump. It will also be noted that while in the embodiment of the present invention set forth in FIGS. 1 through 4, manifolds 60 and 65 (seen in FIG. 1) commonly couple the pump section pair formed by pump sections 30 and 31 to crossover valve 70 and commonly couple pump sections 32 and 33 to crossover valve 70. However, it will be apparent to those skilled in the art, that individual fluid couplings may be utilized with each of the pump sections within the present invention pump utilizing individual crossover valves for alternately coupling the pump section to the fluid reservoir and the high pressure output line in accordance with movement direction of carriage 11.

Figure 6:
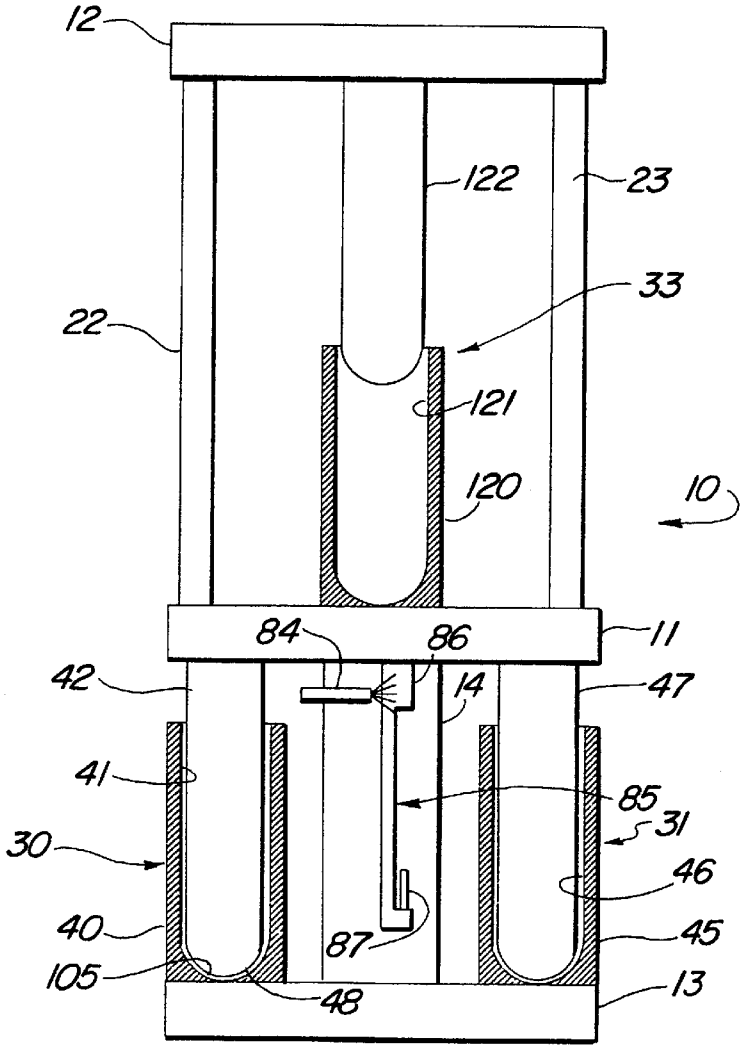
FIG. 6 sets forth a partially sectioned simplified view of the present invention double-acting rod pump having the carriage in the fully lowered position.
Figure 5:
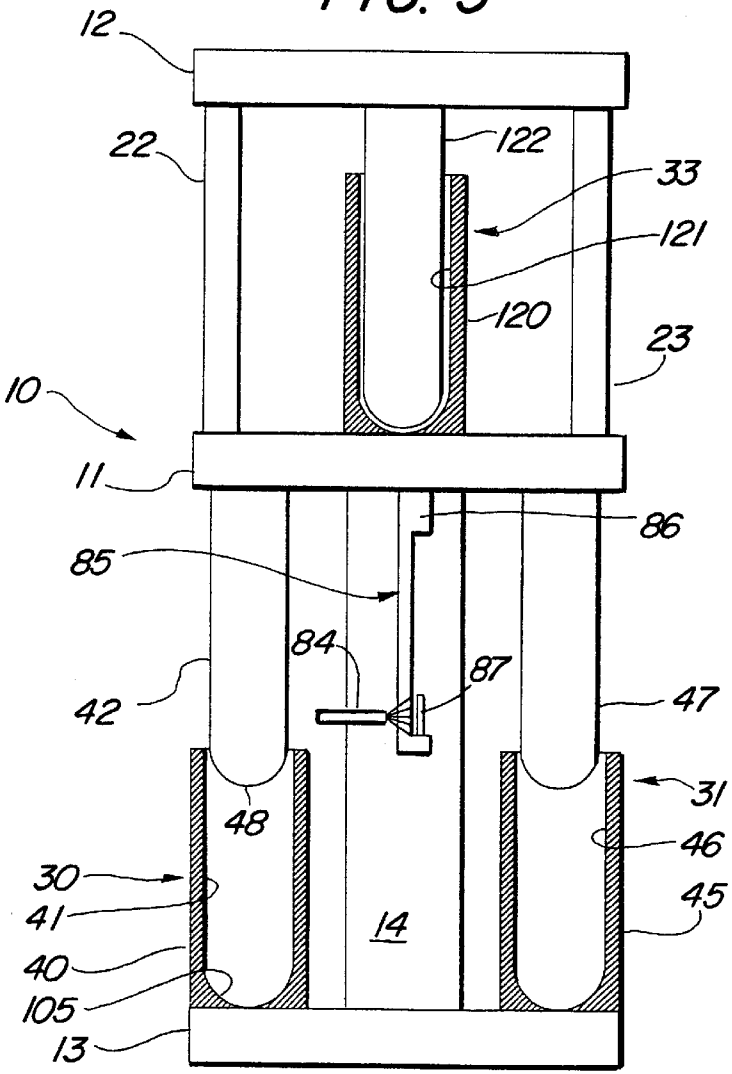
FIG. 5 sets forth a partially sectioned simplified view of the present invention double-acting rod pump having the carriage in the fully raised position.

FIGS. 5 and 6 set forth identical partial section side elevation views of pump 10 which are somewhat simplified diagrams. The simplified diagrams of FIGS. 5 and 6 are utilized to show the operation of sensor 84 and targets 86 and 87. Thus, it will be understood that a number of detailed structural features of pump 10 have been omitted in the partial section views of FIGS. 5 and 6 to avoid unduly cluttering the drawing Figures. By way of further overview, FIG. 5 shows pump 10 having carriage 11 raised to its maximum upward position while FIG. 6 shows pump 10 having carriage 11 lowered to its maximum lowered position.

More specifically, pump 10 includes a pair of plates 12 and 13 supported by a plurality of guide rods such as guide rods 22 and 23. A carriage 11 defines a plurality of apertures (seen in FIG. 1) which receive the guide rods to slidably support carriage 11. A pump screw 14 is coupled to carriage 11 in the manner set forth above such that rotation of pump screw 14 raises and lowers carriage 11 depending upon direction of pump screw rotation.

Plate 13 supports a pair of pump sections 30 and 31 having respective fluid cylinders 40 and 45 secured to plate 13. Fluid cylinders 40 and 45 define respective bores 41 and 46 and respective closed ends such as closed end 105 of fluid cylinder 40. Pump sections 30 and 31 further include elongated cylindrical pump rods 42 and 47 receivable within bores 41 and 46 respectively. The upper ends of pump rods 42 and 47 are secured in the manner described above to the underside of carriage 11.

Pump 10 further includes a pair of pump sections 32 and 33 (pump section 32 seen in FIG. 4). Pump section 33 includes a fluid cylinder 120 defining a bore 121. Fluid cylinder 120 is secured to the upper surface of carriage 11 using conventional fasteners such as those shown in FIG. 2. Pump section 33 further includes an elongated generally cylindrical pump rod 122 secured to the underside of plate 12 and extending into bore 121. While not visible in the drawing, it will be understood that pump section 32 (seen in FIG. 4) is identical to pump section 33 and is positioned in alignment therewith as shown in FIG. 4.

In further accordance with the present invention, pump 10 includes a target support 85 secured to the underside of carriage 11 and supporting an upper target 86 and a lower target 87. In the preferred fabrication of the present invention, targets 86 and 87 differ substantially in size. Thus, in the embodiment shown, upper target 86 is substantially larger than lower target 87. An optical sensor 84 is supported in the manner described above in FIG. 1, and is operative to sense the alignment of either of targets 86 or 87 with sensor 84 and produce an output signal indicative of either target which allows control unit 80 (seen in FIG. 1) to distinguish which of targets 86 or 87 are aligned with sensor 84.

In the position of carriage 11 shown in FIG. 5, carriage 11 has moved upwardly to a position in which smaller target 87 is aligned with sensor 84. The resulting sensed presence of small target 87 detected by sensor 84 produces a reduced signal indicative of the smaller size of target 87. In this manner, control unit 80 (seen in FIG. 1) is able to properly reverse the direction of rotation of pump screw 14. Thus, as target 87 is moved into alignment with sensor 84 due to the raised position of carriage 11, control unit 80 (seen in FIG. 1) reverses the rotation of pump screw 14 and begins lowering carriage 11. The lowering of carriage 11 continues until upper target 86 is aligned with sensor 84. At this point, sensor 84 again puts out an output signal. The resulting configuration of pump 10 due to lowering of carriage 11 is shown in FIG. 6.

FIG. 6 sets forth the section view of FIG. 5 of pump 10 showing carriage 11 having been lowered to its lowest position. Of importance to note, is the alignment of upper target 86 with sensor 84.

More specifically, pump 10 includes a pair of plates 12 and 13 supported by a plurality of guide rods such as guide rods 22 and 23. A carriage 11 defines a plurality of apertures (seen in FIG. 1) which receive the guide rods to slidably support carriage 11. A pump screw 14 is coupled to carriage 11 in the manner set forth above such that rotation of pump screw 14 raises and lowers carriage 11 depending upon direction of pump screw rotation.

Plate 13 supports a pair of pump sections 30 and 31 having respective fluid cylinders 40 and 45 secured to plate 13. Fluid cylinders 40 and 45 define respective bores 41 and 46 and respective closed ends such as closed end 105 of fluid cylinder 40. Pump sections 30 and 31 further include elongated cylindrical pump rods 42 and 47 receivable within bores 41 and 46 respectively. The upper ends of pump rods 42 and 47 are secured in the manner described above to the underside of carriage 11.

Pump 10 further includes a pair of pump sections 32 and 33 (pump section 32 seen in FIG. 4). Pump section 33 includes a fluid cylinder 120 defining a bore 121. Fluid cylinder 120 is secured to the upper surface of carriage 11 using conventional fasteners such as those shown in FIG. 2. Pump section 33 further includes an elongated generally cylindrical pump rod 122 secured to the underside of plate 12 and extending into bore 121. While not visible in the drawing, it will be understood that pump section 32 (seen in FIG. 4) is identical to pump section 33 and is positioned in alignment therewith as shown in FIG. 4.

In further accordance with the present invention, pump 10 includes a target support 85 secured to the underside of carriage 11 and supporting an upper target 86 and a lower target 87. In the preferred fabrication of the present invention, targets 86 and 87 differ substantially in size. Thus, in the embodiment shown, upper target 86 is substantially larger than lower target 87. An optical sensor 84 is supported in the manner described above in FIG. 1, and is operative to sense the alignment of either of targets 86 or 87 with sensor 84 and produce an output signal indicative of either target which allows control unit 80 (seen in FIG. 1) to distinguish which of targets 86 or 87 are aligned with sensor 84.

With carriage 11 having moved downwardly a sufficient distance to align target 86 with sensor 84, the larger size of target 86 produces a larger amplitude signal at sensor 84. This larger amplitude signal is detected by control unit 80 (seen in FIG. 1) and causes control unit 80 to reverse the rotational direction of pump screw 14 thereby again raising carriage 11. This cycle repeats as carriage 11 is alternatively raised to the position shown in FIG. 5 and lowered to the position shown in FIG. 6 which represents the cycling of pump 10. It will be apparent to those skilled in the art that the relative sizes of upper target 86 and lower target 87 may be reversed without departing from the spirit and scope of the present invention. The important aspect with respect to targets 86 and 87 and sensor 84 is the production of an output signal as each is aligned with sensor 84 which may be distinguished from the signal produced during alignment of the other one of targets 86 and 87. In other words, control unit 80 (seen in FIG. 1) must be able to distinguish the upper target from the lower target in order to set the proper direction of rotation of pump screw 14.

Figure 7:
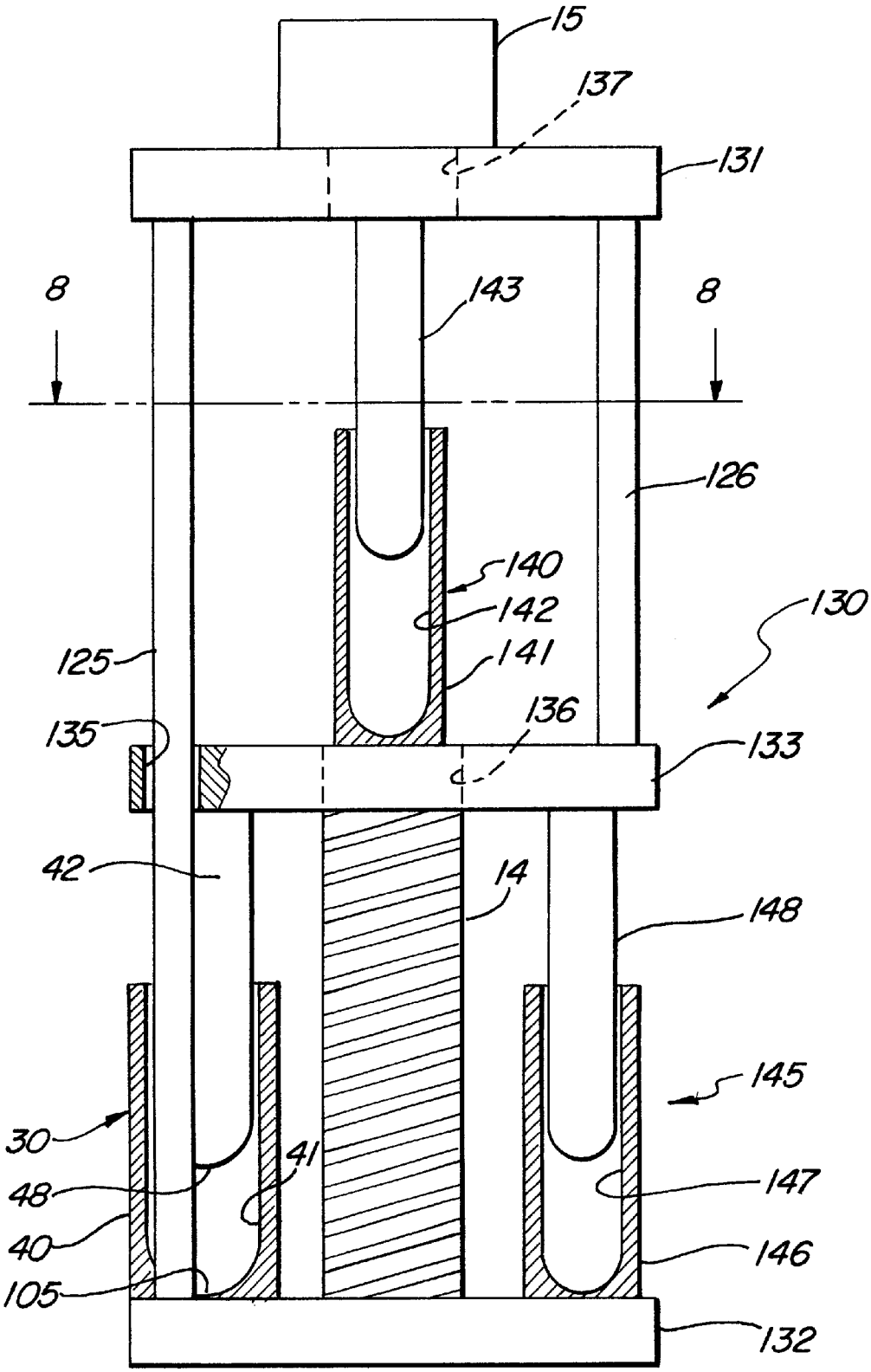
FIG. 7 sets forth a partially sectioned simplified view of an alternate embodiment of the present invention double-acting rod pump.

FIG. 7 sets forth a partial section view of an alternate embodiment of the present invention double-acting rod pump. The section view of FIG. 7 presents a simplified diagram of pump 130 which is similar to section views shown in FIGS. 5 and 6 in that various structural details of the pump are omitted to avoid unduly cluttering the drawing and to enable the clear illustration of the features sought to be described in FIG. 7.

In essence, pump 130 differs from pump 10 shown in FIG. 1 in its use of differently sized diameter pump sections to obtain different flow rates of the fluids being pumped thereby as the carriage is moved. But for this difference in pump section diameter size, the structure of pump 130 will be understood to be identical to the structure of pump 10 shown in FIG. 1. Accordingly, pump 130 includes an upper plate 131 and a lower plate 132 supported by a plurality of guide rods such as guide rods 125 and 126. It will be understood that in the preferred fabrication of pump rod 30, a plurality of guide rods will extend between plates 131 and 132 in the manner shown as guide rod 125 and in similarity to the above described structures.

Plate 132 supports a pair of pump sections 30 and 145 having respective fluid cylinders 40 and 146 secured to plate 132. As described above, fluid cylinder 40 defines a bore 41 and a domed closed end 105. Similarly, fluid cylinder 146 defines a bore 147. Pump section 30 includes a pump rod 42 having a lower end 48 received within bore 41 while pump section 145 defines a pump rod 148 received within bore 147. Pump rods 42 and 148 are secured to the underside of a movable carriage 133. Carriage 133 is substantially identical to carriage 11 in the embodiment shown in FIG. 1, and thus defines a plurality of apertures supporting bearings therein such as aperture 135 through which the plurality of guide rods such as guide rod 125 extend. In further similarity to pump 10 described above, pump 130 includes a pump screw 14 which extends upwardly from pump 132 through an aperture 136 formed in carriage 133. While not seen in FIG. 7, due to the section view thereof, it will be understood that pump screw 14 extends upwardly through and aperture 137 formed in upper plate 131 and beyond. Also in the manner set forth above, it will be understood that the upper end of pump screw 14 is coupled to motor 15.

Pump 130 further includes a pair of pump sections 140 and 31 (pump section 31 seen in FIG. 8) which are coupled between carriage 133 and upper plate 131. It will be further understood that pump sections 140 and 31 are substantially identical to pump sections 145 and 30 respectively. Thus, the illustration and description of pump section 140 shown in FIG. 7 and described in conjunction therewith will be understood to be equally illustrative and descriptive of pump section 145 (seen in FIG. 8). Thus, pump section 140 includes a fluid cylinder 141 secured to the upper surface of carriage 133. Fluid cylinder 141 defines a closed end bore 142. Pump section 140 further includes an elongated generally cylindrical pump rod 143 secured to the undersurface of upper plate 131 in the manner described above. Of importance to note with respect to the alternate embodiment represented by pump 130 is the difference in diameters presented by pump sections 140 and 145 relative to the diameters represented by pump sections 30 and 31. Thus, by way of example, pump sections 140 and 145 are shown having a substantially smaller diameter bores within fluid cylinders 141 and 146 as well as substantially smaller diameter pump rods 143 and 148 relative to the corresponding bores and pump rods of pump sections 30 and 31. The use of pump sections having differing bores allows the movement of carriage 133 to dispense different fluids at different flow rates. Thus, it will be apparent as carriage 133 moves, a substantially greater volume of fluid is pumped by pump sections 30 and 31 relative to pump sections 140 and 145 (pump section 31 seen in FIG. 8). It will be apparent to those skilled in the art that a virtually endless variety of different diameter pump sections may be utilized either above or below carriage 133 without departing from the spirit and scope of the present invention. When such differing size pump sections are utilized, the flexibility of the present invention double-acting pump become virtually endless.

Figure 8:
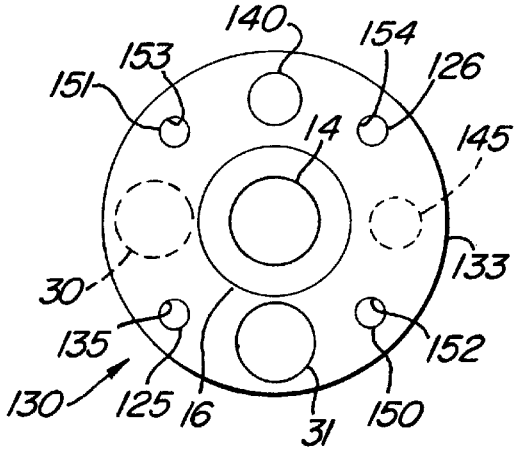
FIG. 8 sets forth a section view of the embodiment of the present invention double-acting rod pump shown in FIG. 7 taken along section lines 8—8 therein.

FIG. 8 sets forth a section view of pump 130 taken along section lines 8—8 in FIG. 7. Thus, pump 130 includes a carriage 133 having a ball nut 16 secured thereto. Ball nut 16 receives a pump screw 14 in a threaded engagement. Carriage 133 further defines a plurality of apertures having respective bearings 135, 152, 153 and 154. Pump 130 further includes a plurality of guide rods 125, 150, 151 and 126 which extend through bearings 135, 152, 153 and 154 respectively to slidably support carriage 133.

In accordance with the alternate embodiment of the present invention illustrated by pump 130, carriage 133 supports a smaller diameter pump section 140 and a larger diameter pump section 31 extending upwardly from carriage 133. A larger diameter pump section 30 and a smaller diameter pump section 145 extend downwardly from carriage 133. Once again, it will be understood that the combination of differently sized pump sections illustrated by pump 30 in FIGS. 7 and 8 is representative of a variety of combinations of differently sized pump sections which may be utilized in the present invention double-acting rod pump to provide differing fluid flows.

FIG. 9 sets forth a section view of a still further alternate embodiment of the present invention double-acting rod pump having a total of six pump sections which is generally referenced by numeral 160. Pump 160 differs from pump 10 set forth above in that carriage 163 supports a total of six pump sections. However, in all other respects, pump 160 will be understood to be identical to the fabrication of pump 10 set forth and described above. Accordingly, pump 160 includes a carriage 163 slidably supported by a plurality of guide rods 165, 166, 167 and 168. Guide rods 165 through 168 slidably support 163 in the identical manner set forth above in FIG. 1 for carriage 11 in its sliding support upon guide rods 20 through 23.

Returning to FIG. 9, pump 160 includes a trio of pump sections 170, 171 and 172 supported upon the upper surface of carriage 163 and operative in the identical manner to pump sections 32 and 33 shown in the embodiments of FIGS. 1 through 3. Similarly, pump 160 includes a second trio of pump sections 175, 176 and 177 supported beneath carriage 163 and operative in the identical fashion to pump sections 30 and 31 shown in FIG. 1.

In accordance with an important aspect of the present invention, pump sections 170 through 172 as well as pump sections 175 through 177 of pump 160 may be operated in various combinations or independently coupled to independent valves to provide a variety of fluid flow combinations. Additionally, pump sections 170 through 172 and pump sections 175 through 177 may be commonly coupled to respective manifolds in the manner shown in the embodiment of FIG. 1 to provide additional fluid flow and to facilitate use of a single crossover valve such as crossover valve 70.

FIG. 10 sets forth a section view of a still further alternate embodiment of the present invention double-acting rod pump generally referenced by numeral 180. Pump 180 differs from the embodiment set forth above in that it utilizes a total of eight pump sections. However, in all other respects, pump 180 is substantially the same as the embodiments set forth above such as pump 10 shown in FIG. 1. Thus, pump 180 includes a carriage 183 slidably supported by a plurality of guide rods 184, 185, 186 and 187. By way of further similarity, carriage 183 supports a ball nut 16 which engages a rotatable pump screw 14. Thus, in the manner described above for pump 10, carriage 183 is moved up and down in response to rotation of pump screw 14. Carriage 183 supports a plurality of pump sections 190, 192, and 193 symmetrically arranged upon carriage 183. Pump 180 further includes a second plurality of pump sections 195, 196, 197 and 198 also symmetrically arranged upon carriage 183 and extending downwardly therefrom. Thus, pump sections 190 through 193 operate in the manner set forth and described above for pump sections 32 and 33 (seen in FIGS. 1 and 4). Conversely, pump sections 195 through 198 operate in the same fashion as pump sections 30 and 31 set forth above in FIGS. 1 and 4. The use of four pump sections on each side of carriage 183 allows pump 180 to provide substantially greater fluid flow and flexibility of operating different fluids as carriage 183 is moved up and down in the above described double-acting pump operation.

Figure 11:
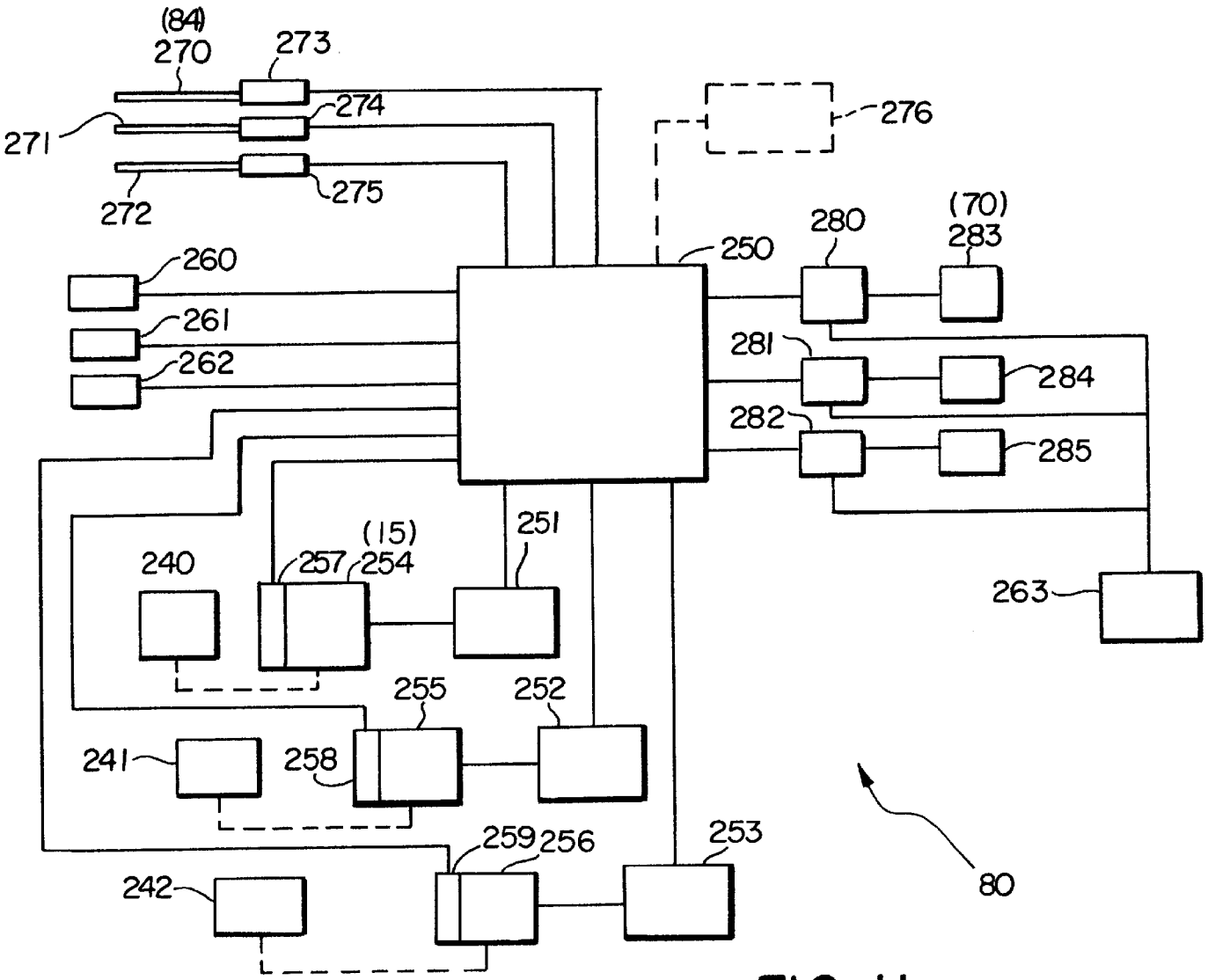
FIG. 11 sets forth a block diagram of the electronic control unit of the present invention double-acting rod pump.

FIG. 11 sets forth a block diagram of control unit 80. In the preferred embodiment of the present invention, control unit 80 is configured to control three pumps such as pump 10 shown in FIG. 1. It will be apparent however that control unit 80 may control a single pump as seen in FIG. 1 or a plurality of pumps as desired. In essence, control unit 80 comprises three sets of components to control up to three pumps.

More specifically, control unit 80 includes a controller board 250 coupled to a trio of motor driver boards 251, 252 and 253. Motor driver boards 251, 252, and 253 may comprise conventional devices such as Minarik Model RG—500 or the like. A trio of reversible motors 254, 255 and 256 are operatively driven by motor drivers 251, 252 and 253 respectively. Motors 254, 255 and 256 may comprise conventional motors and preferably support respective optical encoders 257, 258 and 259 respectively also of conventional fabrication.

A trio of pressure sensors 260, 261 and 262 are coupled to controller board 250 and are operative to monitor output pressure at a corresponding set of pumps 240, 241 and 242. Pumps 240, 241 and 242 are constructed in accordance with the present invention. A trio of sensors 270, 271 and 272 are operative in the manner described above in FIG. 1 as sensor 84. In the preferred fabrication of the present invention, sensors 270, 271 and 272 comprise fiber-optic elements coupled to amplifiers 273, 274 and 275 respectively which in turn are coupled to controller board 250.

Control unit 84 further includes a trio of crossover valves 283, 284 and 285 which are operated by solenoid valves 280, 281 and 282. Crossover valves 283, 284 and 285 are air-driven from a compressed air supply 263 using solenoid valves 280, 281, and 282 and function in the manner described above in FIG. 3 (valve 70) to control fluid flow to and from the pluralities of pump segments.

As described above, the double-acting rod pumps of the present invention are controlled as to carriage motion (for example carriage 11 seen in FIG. 1) in response to cooperating sensors and targets (for example targets 86 and 87 in FIG. 1). However, the present invention pumps may also be controlled by encoders 257, 258 and 259 in combination with sensors and targets. By way of further variation, pumps may be controlled by movement at constant speed using an optional timer 276. Because the rate of fluid flow from the pump sections is constant when its drive is constant, fluid volume is directly related to pump "operation time".

Figure 12:
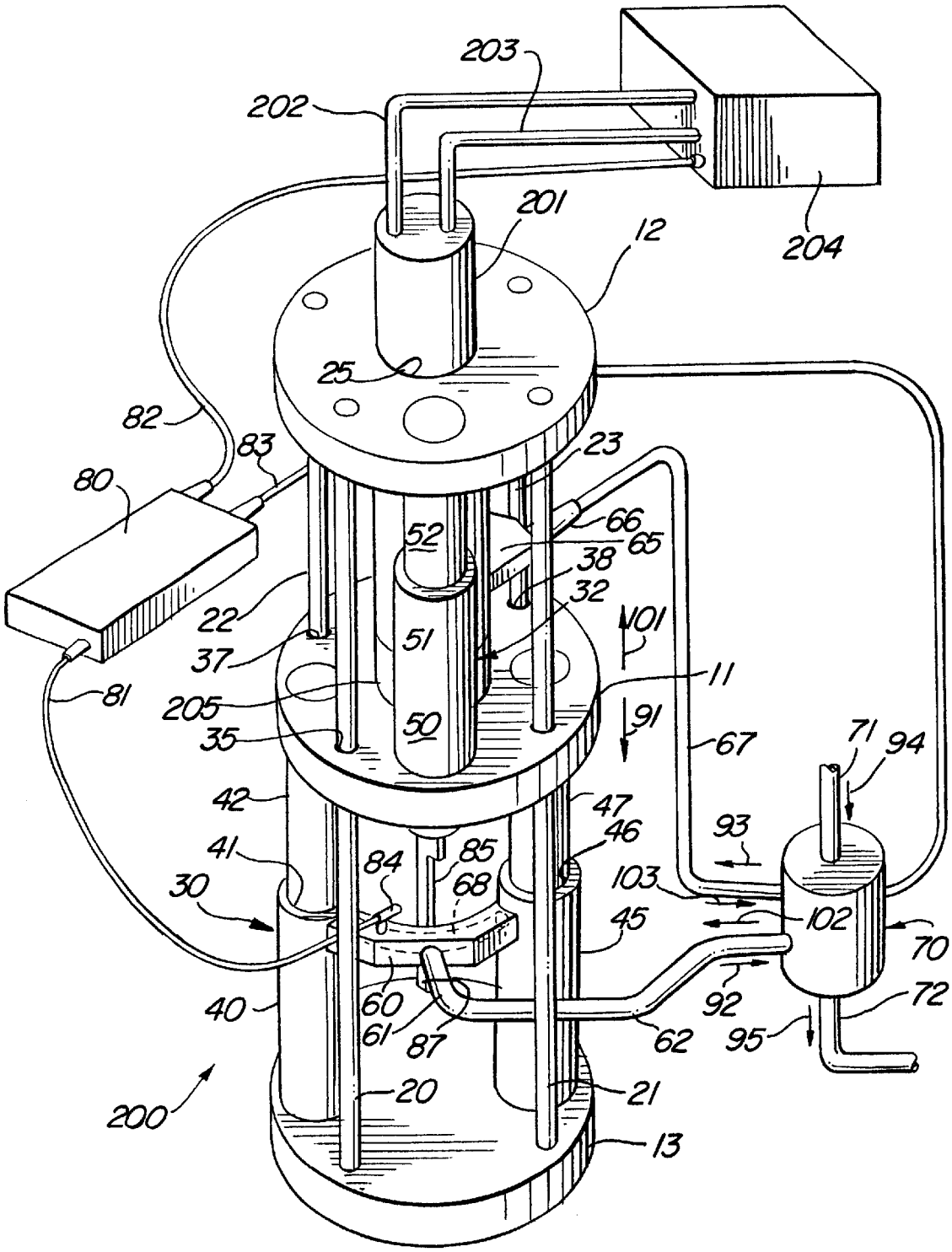
FIG. 12 sets forth a perspective view of a still further alternate embodiment of the present invention double-acting rod pump.

FIG. 12 sets forth a perspective view of a further alternate embodiment of the present invention double-acting rod pump generally referenced by numeral 200. By way of overview, pump 200 is substantially identical to pump 10 described above with the exception of the use of a double-acting hydraulic cylinder being used in place of pump screw 14, ball nut and motor 15 to move carriage 11. Thus, pump 200 includes a pair of end plates 12 and 13 supported in a spaced apart relationship by a plurality of elongated cylindrical rigid guide rods 20, 21, 22, and 23. Guide rods 20 through 23 are secured to end plates 12 and 13 in accordance with conventional fabrication techniques such as threaded fastening or the like (not shown) to provide a rigid frame structure. Thus, end plates 12 and 13 as well as guide rods 20 through 23 are preferably formed of a rigid metal material or the like. Pump 200 further includes a carriage 11 having a plurality of bearings 35, 36, 37 and 38 through which guide rods 20, 21, 22 and 23 respectively are passed. The size relationship of bearings 35 and 38 and guide rods 20 through 23 is a precision sliding fit allowing carriage 11 to move upon guide rods 20 through 23 in the directions indicated by arrows 91 and 101.

Pump 200 further includes double-acting hydraulic cylinder 201 coupled to carriage 11 by an attachment 205 and secured to plate 12 in accordance with conventional fabrication techniques. End plate 12 defines an aperture 25 through cylinder 201 passes. Hydraulic cylinder 201 is coupled to a conventional hydraulic control 204 by hydraulic lines 202 and 203. Hydraulic control 204 is constructed in accordance with conventional fabrication techniques and comprises a precision bi-directional fluid controller for moving double-acting hydraulic cylinder 201 in either of the directions indicated by arrows 101 and 91.

In accordance with the present invention, a pair of pump sections 30 and 31 are coupled between end plate 13 and the underside of carriage 11. Pump sections 30 and 31 comprise precision rod pumps having respective fluid cylinders 40 and 45 and defining respective closed end bores 41 and 46. Further, pump section 30 includes a pump rod 42 received within bore 41 having its upper end secured to carriage 11 in the manner set forth below. Similarly, pump section 31 includes a precision pump rod 47 extending into bore 46 and having its upper end connected to carriage 11. As is set forth above in FIG. 2, fluid cylinders 40 and 45 define respective port apertures which are coupled to a manifold 60. Manifold 60 is supported upon fluid cylinders 40 and 45 and defines an internal manifold passage 68. Passage 68 conducts fluid from the respective ports of fluid cylinders 40 and 45 to a coupler 61 also secured to manifold 60.

Pump 200 further includes a second pair of pump sections 32 and 33 (pump section 33 seen above in FIG. 4). In the embodiment of FIG. 12, pump sections 32 and 33 are substantially identical to pump sections 30 and 31. However, it will be noted in embodiments set forth above, that different pump sections may be utilized within the same double-acting pump apparatus of the invention without departing from the spirit and scope thereof. However, suffice it to note here, that pump section 32 is substantially identical to pump sections 30 and 31 in the embodiment of pump 10 shown in FIG. 12. Thus, pump section 32 includes a fluid cylinder 50 defining an internal closed end bore 51. Fluid cylinder 50 is secured to carriage 11 in the manner set forth below. Pump section 32 also includes a precision pump rod 52 received within bore 51. The upper end of pump rod 52 is secured to end plate 12. While not seen in the perspective view of FIG. 12 due to the presence of hydraulic cylinder 201, it will be understood that pump section 33 (seen in FIG. 4) is positioned on the opposite side of end plate 12 and is coupled between carriage 11 and end plate 12 in the identical manner to the relationship of pump section 32. By way of further similarity of pump sections 30 and 31, pump sections 32 and 33 are coupled to a manifold 65 which is substantially identical to manifold 60. Thus, manifold 65 defines an internal coupling passages such as passage 68 of manifold 60 which communicate fluid flow to-and-from pump sections 32 and 33 to a coupler 66.

Pump 200 further includes a sensor 84 which preferably comprises an optical sensor and detector of conventional fabrication. Typically, sensor 84 is fabricated to include a light source such as a light emitting diode (LED) together with a photo sensitive element such as a photo transistor. The function of sensor 84 is fulfilled as the sensor illuminates the region directly in front of the sensor and produces a signal output in response to the amount of light reflected back to the photo sensitive element therein. Pump 200 further includes a sensor target support 85 secured to carriage 11 by conventional fasteners or the like (not shown). Target support 85 includes a relatively upper target 86 and a relatively lower target 87 at the opposed ends thereof. The remainder of target support 85 is fabricated and positioned with respect to sensor 84 such that a greatly reduced return reflection is received by sensor 84 unless either of targets 86 or 87 are moved into alignment with sensor 84. The operation of sensor 84 and targets 86 and 87 is set forth above in FIGS. 5 and 6 in greater detail. However, suffice it to note here, that sensor 84 is able to produce a first signal output condition indicative of the alignment of upper target 86 with sensor 84 and a second signal condition indicative of the alignment of target 87 with sensor 84.

Pump 200 further includes a crossover valve 70 the operation of which is illustrated above in FIG. 3 in greater detail. Suffice it to note here, that crossover valve 70 is electrically and pneumatically operated and is of conventional fabrication techniques providing conventional switching of fluid flow. Accordingly, crossover valve 70 is coupled to a fluid supply line 71 which, as is seen in FIG. 3, is further coupled to a fluid reservoir 73. Further, crossover valve 70 is coupled to a pressure output line 72. The couplings of crossover valve 70 are completed by a fluid line 62 which couples fluid flow from coupler 61 of manifold 60 to crossover valve 70 and a fluid line 67 which couples a fluid flow between crossover valve 70 and coupler 66 of manifold 65.

Finally, pump 200 includes a control unit 80 having an electronic control circuit operative therein. Control unit 80 includes a signal input line 81 coupled to sensor 84 and a valve control line 83 operatively coupled to crossover valve 70. Control unit 80 further includes, a hydraulic control line 82 coupled to hydraulic control 204. While not seen in FIG. 12, it will be understood that control unit 80 is also coupled to a convention source of operative power which is utilized in controlling crossover valve 70 and bi-directional motor 15.

In operation, and by way of overview, the entire operation of pump 200 is substantially identical to the operation of pump 10 described above with the exception of the use of double-acting hydraulic cylinder 201 to move carriage 11 up and down in the direction indicated by arrows 91 and 101. More specifically, control unit 80 and hydraulic control 204 cooperate to supply high pressure hydraulic fluid to hydraulic cylinder 201 via hydraulic lines 202 and 203 to provide movement of carriage 11. The double-acting structure of hydraulic cylinder 201 is fabricated in accordance with conventional fabrication techniques and is able to apply a downward force upon carriage 11 moving carriage 11 in the direction indicated by arrow 91 or conversely, is able to apply an upward drawing force upon carriage 11 moving carriage 11 in the direction indicated by arrow 101. The movement of carriage 11 in response to double-acting hydraulic cylinder 201 results in the identical operation of pump sections 30 through 33 (seen in FIG. 4) described above. Thus, continuous pumping action is provided as control unit 80 operates hydraulic control 204 to properly apply hydraulic fluid under pressure to double-acting hydraulic cylinder 201.

Figure 13:
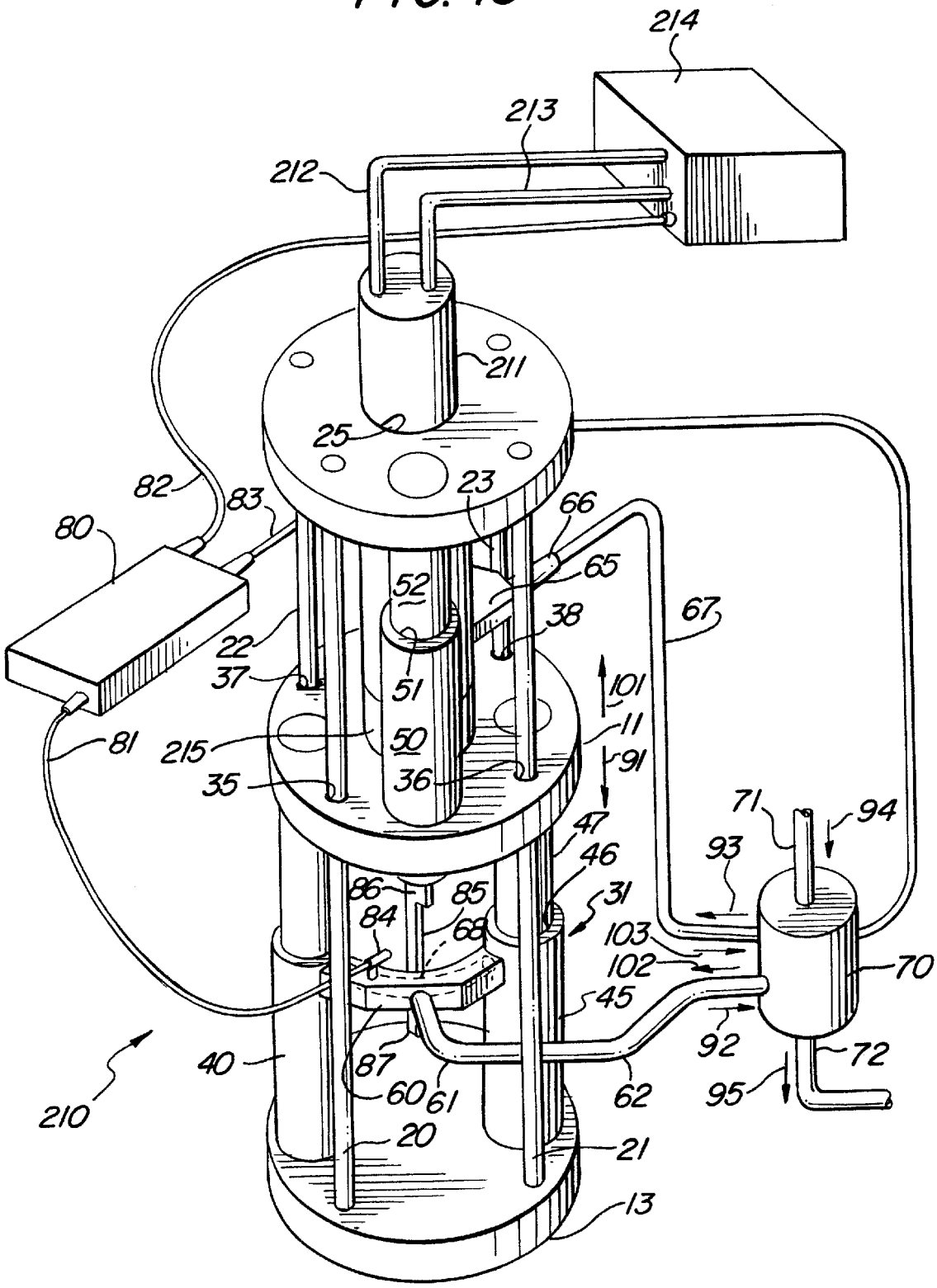
FIG. 13 sets forth a perspective view of a still further alternate embodiment of the present invention double-acting rod pump.

FIG. 13 sets forth a perspective view of a still further alternate embodiment of the present invention which is substantially identical to the structures shown in FIGS. 1 and 12 with the difference being found in the use of a pneumatic or air driven cylinder in place of pump screw 14 and hydraulic cylinder 201 respectively. Thus, the operative structure shown in FIG. 13 which is generally referenced as pump 210 utilizes a double-acting pneumatic cylinder 211 to move carriage 11. Cylinder 211 is fabricated in accordance with conventional fabrication techniques and is coupled to carriage 11 by a conventional attachment 215. A pneumatic control 214 coupled to a source of high pressure air (not shown) is operatively coupled to double-acting pneumatic cylinder 211 by high pressure lines 212 and 213. Control unit 80 is operatively coupled to pneumatic control 214 to provide controlling electronic signals for operating control unit 214.

The operation of pump 210 is substantially identical to the operation of pump 200 set forth in FIG. 12 and described above with the sole difference being found in the use of a pneumatically actuated cylinder 211 operative in response to high pressure air rather than the hydraulic cylinder utilized in pump 200. In all other respects, the operation of pump 210 is identical to the above described embodiments such as pump 200 shown in FIG. 12.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A double-acting rod pump comprising:

a frame support;

a carriage slidably movable upon said frame support in first and opposed directions;

at least one first rod pump section coupled to said carriage and said frame support;

at least one second rod pump section coupled to carriage and said frame support in an operational relationship opposite to said at least one first rod pump section;

a pump screw rotatably supported by said support frame;

a bi-directional motor for rotating said pump screw in first and second rotational directions;

engagement means on said carriage for engaging said pump screw such that first and second rotational direction rotation of said pump screw moves said carriage in opposed first and second direction movement; and valve means coupled to said at least on first rod pump section and said at least one second rod pump section for controlling fluid flow to and from said first and second rod pump sections.

2. The double-acting rod pump set forth in claim 1 wherein said bi-directional motor includes an electric motor and wherein said double-acting rod pump further includes a control unit having means for controlling the operation of said motor to reciprocate said at least one first rod pump and said at least on second rod pump.

3. The double-acting rod pump set forth in claim 2 wherein said electric motor includes an encoder, operatively coupled to said means for controlling, providing carriage position information to said means for controlling.

4. The double-acting rod pump set forth in claim 3 wherein said means for controlling further includes a time and wherein said electric motor is operated at a constant speed.

5. A double-acting rod pump comprising:

first and second end plates;

a plurality of guide rods secured to said end plates to support said end plates in a spaced apart relationship;

a carriage slidably supported between said end plates by said guide rods;

a pump screw supported by said first and second end plates;

motor means for rotating said pump screw in first and second opposed directions of rotation;

engagement means supported by said carriage for engaging said pump screw and causing said carriage to move in first and second directions in response to rotation of said pump screw in said first and second opposed directions or rotation respectively;

a first plurality of rod pump sections each having a first fluid cylinder supported by said carriage and first pump rod supported by said first end plate and extending into said first fluid cylinder;

a second plurality of rod pump sections each having a second fluid cylinder supported by said second end plate and a second pump rod supported by said carriage and extending into said second fluid cylinder; and valve means coupled to said first and second pluralities of rod pump sections for controlling fluid flow to and from said first and second pluralities of rod pump sections as said carriage is moved.

6. The double-acting rod pump set forth in claim 5 wherein said first plurality of rod pump sections include a first at least one rod pump section having a diameter different from the remaining ones of said first plurality of rod pump sections and wherein said second plurality of rod pump sections include a second at least one rod pump section having a diameter different from the remaining ones of said second plurality of rod pump sections.

7. The double-acting rod pump set forth in claim 6 wherein said first and second at least one of rod pump sections have equal diameters.

8. A double-acting rod pump comprising:

first and second end plates;

a plurality of guide rods secured to said end plates to support said end plates in a spaced apart relationship;

a carriage slidably supported between said end plates by said guide rods;

carriage movement means supported by said first end plate;

engagement means supported by said carriage for engaging said carriage movement means and causing said carriage to move in first and second directions in response to operation of said carriage movement means;

a first plurality of rod pump sections each having a first fluid cylinder supported by said carriage and first pump rod supported by said first end plate and extending into said first fluid cylinder;

a second plurality of rod pump sections each having a second fluid cylinder supported by said second end plate and a second pump rod supported by said carriage and extending into said second fluid cylinder; and valve means coupled to said first and second pluralities of rod pump sections for controlling fluid flow to and from said first and second pluralities of rod pump sections as said carriage is moved.

9. The double-acting rod pump set forth in claim 8 wherein said carriage movement means includes:

a double-acting hydraulic cylinder; and hydraulic control means for operating said hydraulic cylinder to move said carriage.

10. The double-acting rod pump set forth in claim 8 wherein said carriage movement means includes:

a double-acting pneumatic cylinder; and pneumatic control means for operating said pneumatic cylinder to move said carriage.

11. The double-acting rod pump set forth in claim 8 wherein said first plurality of rod pump sections include a first at least one rod pump section having a diameter different from the remaining ones of said first plurality of rod pump sections and wherein said second plurality of rod pump sections include a second at least one rod pump section having a diameter different from the remaining ones of said second plurality of rod pump sections.

12. The double-acting rod pump set forth in claim 11 wherein said first and second at least one of rod pump sections have equal diameters.

13. A double-acting rod pump comprising.

a frame support;

a carriage slidably movable upon said frame support in first and opposed directions;

at least one first rod pump section coupled to said carriage and said frame support;

at least one second rod pump section coupled to carriage and said frame support in an operational relationship opposite to said at least one first rod pump section;

carriage drive means for moving said carriage; and valve means coupled to said at least on first rod pump section and said at least one second rod pump section for controlling fluid flow to and from said first and second rod pump sections.

* * * * *